US009366050B1

(12) United States Patent
Ptaszek

(10) Patent No.: US 9,366,050 B1
(45) Date of Patent: Jun. 14, 2016

(54) INFLATABLE AIRSHIP HANGAR

(71) Applicant: Waldemar Ptaszek, South Orange, NJ (US)

(72) Inventor: Waldemar Ptaszek, South Orange, NJ (US)

( * ) Notice: Subject to any disclaimer, the term of this patent is extended or adjusted under 35 U.S.C. 154(b) by 0 days.

(21) Appl. No.: 14/612,465

(22) Filed: Feb. 3, 2015

(51) Int. Cl.
*E04H 6/44* (2006.01)
*E04B 1/342* (2006.01)
*E04B 1/344* (2006.01)

(52) U.S. Cl.
CPC *E04H 6/44* (2013.01); *E04B 1/342* (2013.01); *E04B 1/344* (2013.01)

(58) Field of Classification Search
CPC ... E04H 15/22; E04H 15/20; E04H 2015/201; E04H 2015/203
USPC ..... 52/DIG. 14, 2.17, 3
See application file for complete search history.

(56) References Cited

U.S. PATENT DOCUMENTS

| | | | | |
|---|---|---|---|---|
| 2,335,300 | A | 11/1943 | Nefi | |
| 2,411,316 | A | 11/1946 | Capita | |
| 2,636,457 | A | 4/1953 | Finlay et al. | |
| 2,797,696 | A * | 7/1957 | Fritsche | E04H 15/38 135/117 |
| 2,850,026 | A | 9/1958 | Leatherman | |
| 2,921,592 | A | 1/1960 | Mackey | |
| 3,113,403 | A * | 12/1963 | MacMillan, Jr. | E04H 15/22 135/115 |
| 3,148,662 | A * | 9/1964 | Morrell | A01K 31/00 119/437 |
| 3,307,301 | A | 3/1967 | Jacobsohn et al. | |
| 3,389,510 | A * | 6/1968 | Stock | E04H 15/22 47/17 |
| 3,953,955 | A * | 5/1976 | Huddle | E04H 15/18 135/119 |
| 3,961,638 | A * | 6/1976 | Huddle | E04B 1/3441 135/117 |
| 4,583,331 | A * | 4/1986 | Hunt | E04H 15/18 135/132 |
| 4,805,355 | A * | 2/1989 | Plant | A01G 9/1415 47/17 |
| 7,013,607 | B1 | 3/2006 | South | |
| 2007/0215752 | A1 | 9/2007 | Steinkerchner et al. | |

FOREIGN PATENT DOCUMENTS

| | | | |
|---|---|---|---|
| DE | 1684561 | * 11/1971 | E04H 15/20 |
| EP | 0199592 | 10/1986 | |
| GB | 1046632 | 10/1966 | |

OTHER PUBLICATIONS

WDL hangar website (http://www.oobject.com/giant-airship-hangars/wdl-hangar/1550/).*

* cited by examiner

*Primary Examiner* — Brian Glessner
*Assistant Examiner* — Adam Barlow
(74) *Attorney, Agent, or Firm* — Pearl Cohen Zedek Latzer Baratz LLP

(57) ABSTRACT

An inflatable hangar for an airship is provided with retractable support frames so that the structure retains sufficient shape when the structure is opened and deflated to permit entrance and exit of an airship. The inflatable structure is thus easily re-inflated. The resulting membrane structure is transportable and cost-effective.

7 Claims, 3 Drawing Sheets

INFLATABLE AIRSHIP HANGAR

BACKGROUND OF THE INVENTION

1. Field of the Invention

The invention is in the field of inflatable structures and is specifically directed to an inflatable hangar for large equipment, such as an airship or other aircraft.

2. Description of the Related Art

Inflatable structures are disclosed, for example, in GB 1,046,632 ("Lobelle"); U.S. Pat. No. 2,850,026 ("Leatherman"); U.S. Pat. No. 3,307,301 ("Jacobsohn"); EP 0199592 ("Plant"); and U.S. Pat. No. 2,921,592 ("Mackey"), which are incorporated by reference for their teaching of materials and techniques known in the art of inflatable structures. Large, lightweight structures with support trusses are described in US 2007/0215752 ("Steinkerchner"); U.S. Pat. No. 7,013,607 ("South"); and U.S. Pat. No. 2,636,457 ("Finlay"), which are also incorporated by reference. The prior art identifies certain problems associated with erecting and collapsing large lightweight structures for housing very large equipment, and in particular the problem of opening and closing the structures to allow for entry and egress of the equipment has not been adequately addressed. Thus it would be a desirable advance in the art to provide an inflatable structure that could accommodate the entry and exit of large equipment and provide for rapid re-inflation afterward.

SUMMARY OF THE INVENTION

Figure 1:
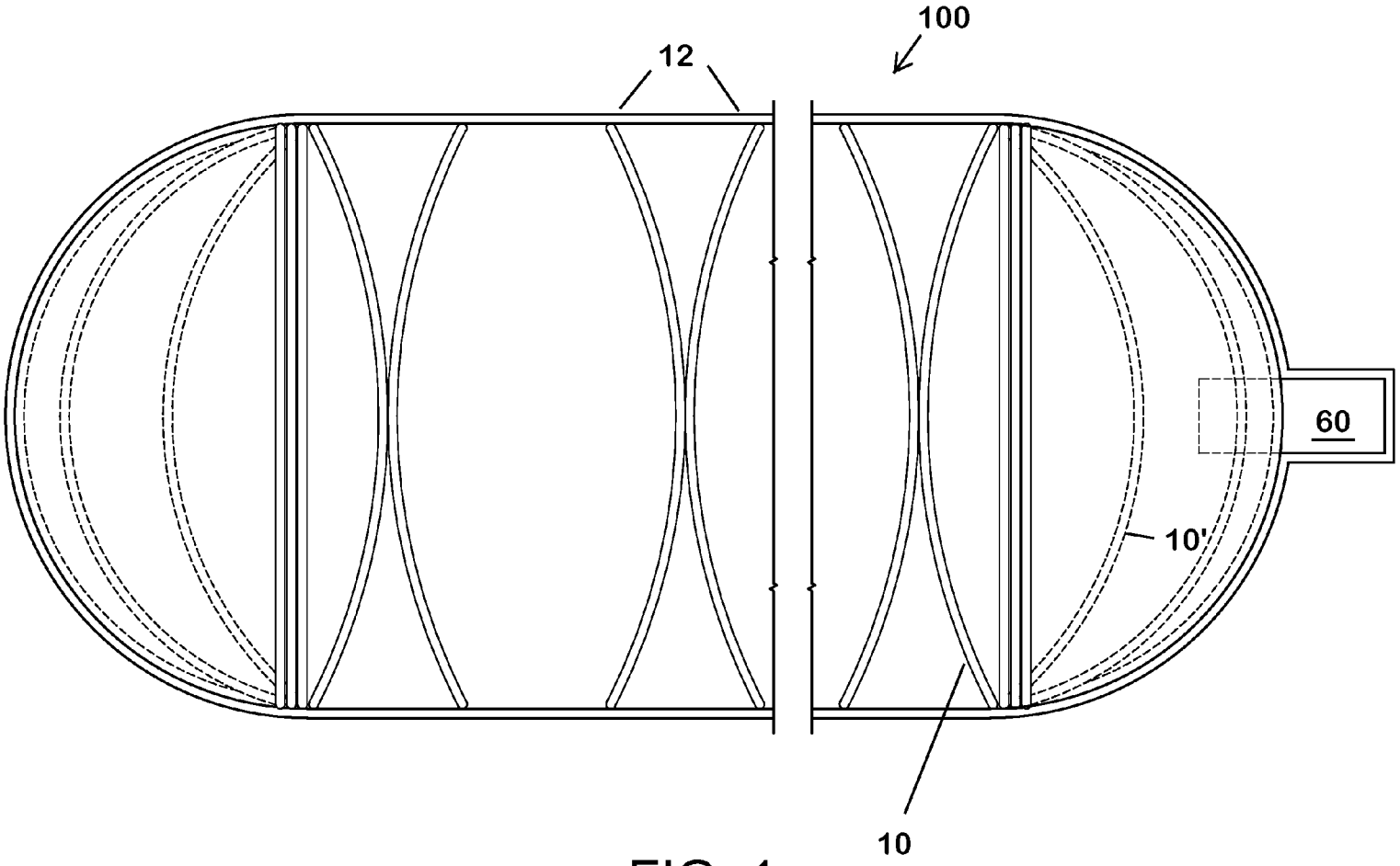
FIG. 1, FIG. 2 and FIG. 3 depict a structure according to an embodiment of the invention, in plan, side and end views.
Figure 2:
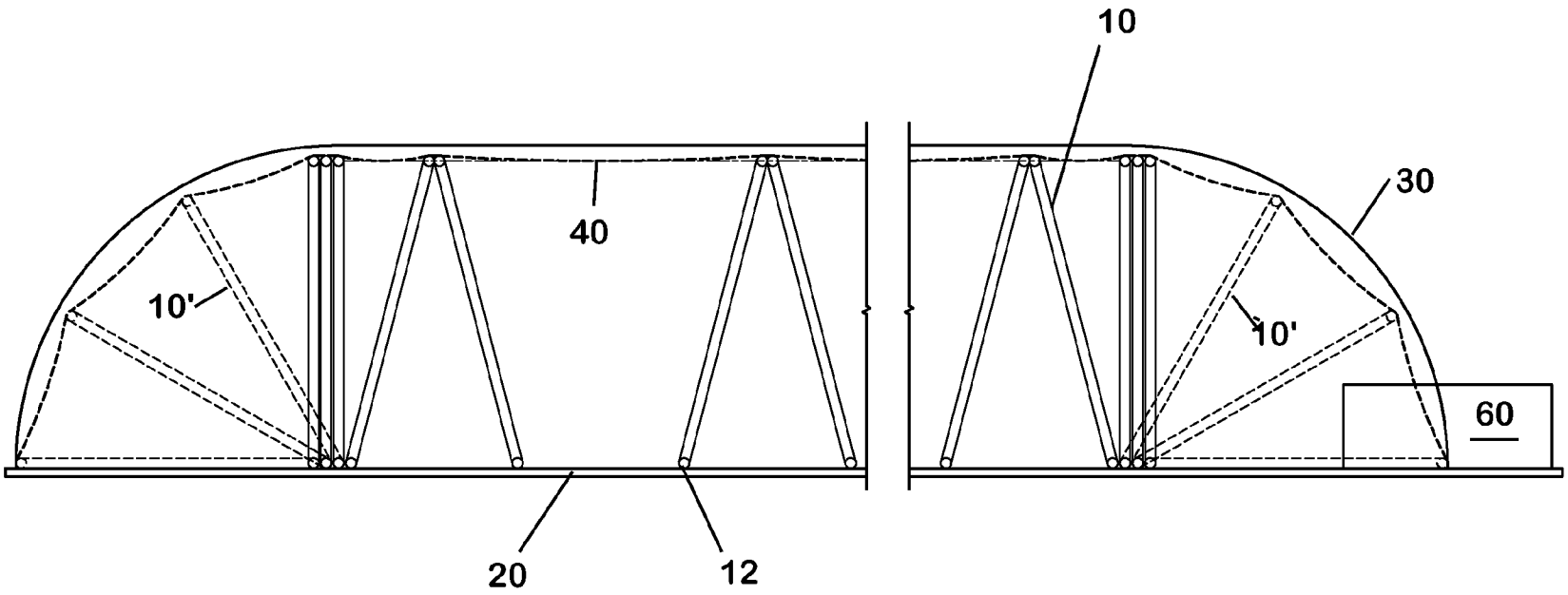
Figure 3:
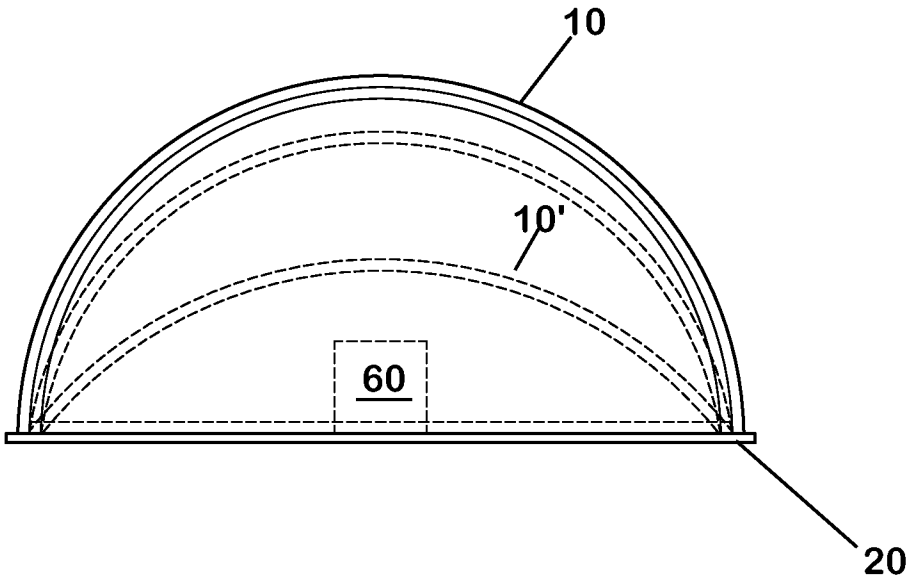

An object of the present invention is to provide a self-supported, inflated structure, solely supported by positive pressure inside, with a rigid frame used only to support the fabric membrane cover in a deflated position. Another object is to provide a structure where one or both ends can quickly and easily be opened and closed while providing necessary internal clearances needed for large airships/aircraft when moved in or out of the structure in the deflated condition.

Another object of the present invention is to provide a rigid frame inside the air structure that will be shaped and constructed in relationship to the air structure fabric wall to accommodate deflection of the air structure under extreme wind conditions and snow loads.

Another object is to provide a portable, pre-fabricated, large structure that can be quickly and easily installed, dismantled and transported.

Another object is to accommodate quick deflation and opening of the structure and quick re-inflation. The structure is equipped with necessary inflation blowers to accommodate rapid re-inflation to minimize exposure to the elements during that time.

These and other objects of the invention are achieved, according to one aspect of the invention, with an inflatable structure for housing an airship, comprising a rigid, lightweight frame; and a flexible, air supported fabric structure. The frame and fabric are not connected to one another and together define a fully pressurized interior space. The frame supports the weight of the flexible fabric in a free standing and upright position after the structure is deflated, at a height to allow large equipment, such as an aircraft or airship to enter and exit the structure.

In another aspect, the invention is a method for opening an inflatable structure having a rigid, lightweight frame and a flexible, air supported fabric cover such that the frame and fabric are not connected to one another and together define a fully pressurized interior space. The method comprises retracting the rigid lightweight frame to an upright position to create a large opening in the structure, and depressurizing the structure so that weight of the fabric is borne by the upright frame when the structure is opened with clearance for the entry and exit of equipment in the deflated state.

DETAILED DESCRIPTION OF THE PREFERRED EMBODIMENTS

The present invention pertains to an inflatable structure in combination with a rigid, internal frame, to be used as a hangar/enclosure for large airships. The air supported structure provides a controlled environment inside the hangar to accommodate construction and/or maintenance of large airships—in some cases more than one airship at a time. The structure is designed to withstand wind and snow loads as required in the geographical area of installation. The structure may be provided with conventional hangar doors, or "Beluga" style doors. The frame is designed to support the cover in a deflated state to allow entry or exit of an airship and rapid re-inflation.

An exemplary embodiment of the structure 100 is shown in plan view in FIG. 1 wherein support frames 10 are anchored to a concrete slab 20 or other earth anchor points 12 at the perimeter of the structure. Any rigid material may be used for the support frames 10; in embodiments, the support frames 10 are steel. The invention is not limited to any particular dimensions, but in embodiments the structure may obtain an overall length of 300 m to 500 m; a width, including an opening, of 100 m to 150 m; and a height of 50 m to 70 m. The support frames 10 may be adapted to form arches reaching from anchor points 12 on opposite sides of the concrete slab 20 and meeting at junction points near the top of the structure. The support frames on opposite ends of the structure are adapted to pivot about respective anchor point 12 to allow for opening the structure as described below.

To accommodate egress or entrance of the airship or aircraft, the support frames on opposite ends of the structure are arranged side-by-side in an upright fashion such that the support frames on the ends of the structure support the fabric membrane of the structure when deflated at a height sufficient to permit entry and exit of the airship, which may be 50 m to 70 m. The support frames 10 toward the middle of the structure likewise bear the fabric and prevent a collapse of the structure with cable(s) 40 attached to the support frames 10 provide additional support for the fabric cover when the structure is deflated. When the structure is inflated or re-inflated, the support frames are adapted to pivot to a position shown in dotted lines 10'. Thus, a clam shell type closure may be provided at one or both ends of the structure having a plurality support frame members 10 pivoting about a common point at ground level, from a closed position in which the interior space can be pressurized to an open position wherein the elongated members are substantially vertical with sections of the flexible fabric folded between them. All of the support frames 10 may be provided with the ability to pivot about ground anchor points 12 to facilitate construction and deconstruction of the structure. The membrane or cover material 30 may be PVC coated polyester or other fabric.

To further facilitate entry of personnel and smaller vehicles and equipment, a vehicle airlock 60 may be provided which may be independently pressurized. The airlock has doors on opposite ends, opened to the enclosed space and to the outside.

Inflation fans (not shown) are provided to maintain pressure within structure, as well as facilitate rapid re-inflation.

The exemplary embodiment shown is not to be deemed limiting of the invention which is defined by the appended claims. One of ordinary skill in the art would be expected to exploit variants within the scope of the present claims. Features and dependent claim limitations described and claimed in connection with one embodiment or independent claim may be combined with another embodiment and independent claim without departing from the scope of the invention.

The invention claimed is:

1. An inflatable structure for housing an airship, comprising:

a rigid, lightweight frame;

a fan for inflating the structure; and a flexible, air supported fabric structure; wherein the frame and fabric are not connected to one another and together define a fully pressurized interior space having a maximum length in a range of 300 feet to 1200 feet, a maximum width in a range of 200 feet to 500 feet and a maximum height of 100 feet to 200 feet, adapted to house an inflated airship; wherein the frame has a free standing and upright position and supports the weight of the flexible fabric only when pressure in said structure is deflated, said support frames arranged upright and side by side on an end of the structure at a height to allow an airship to exit the structure through an opening 50 meters to 70 meters high at the end of the structure.

2. The inflatable structure according to claim 1, wherein the frame is constructed of elongated metal members connected at ends thereof and adjacent metal members meet at junction points located at ground level and near the top of the inflatable structure.

3. The inflatable structure according to claim 2, wherein the elongated members are steel.

4. The inflatable structure according to claim 1, wherein the flexible fabric comprises PVC-coated polyester membrane.

5. The inflatable structure according to claim 1, comprising a clam shell closure at one end thereof comprising a plurality of said elongated frame members pivoting about a common point at ground level, from a closed position in which the interior space can be pressurized to an open position wherein the elongated members are substantially vertical with sections of the flexible fabric folded between them.

6. The inflatable structure according to claim 1, further comprising inflation fans to maintain pressure within structure, as well as facilitate rapid re-inflation of the structure.

7. A method for opening a pressurized structure of claim 1, comprising: retracting the rigid lightweight frame to an upright position to create a large opening in the structure, and depressurizing the structure so that weight of the fabric is borne by the upright frame when the structure is opened.

* * * * *